US011697777B2

(12) United States Patent
Joseph et al.

(10) Patent No.: US 11,697,777 B2
(45) Date of Patent: Jul. 11, 2023

(54) SINGLE REACTOR PROCESS FOR BENZENE-SATURATION/ISOMERTZATION OF LIGHT REFORMATES

(71) Applicant: ABU DHABI OIL REFINING COMPANY—TAKREER, Abu Dhabi (AE)

(72) Inventors: Tony Joseph, Abu Dhabi (AE); Syed Basheer Umar, Abu Dhabi (AE)

(73) Assignee: ABU DHABI OIL REFINING COMPANY—TAKREER, Abu Dhabi (AE)

( * ) Notice: Subject to any disclaimer, the term of this patent is extended or adjusted under 35 U.S.C. 154(b) by 0 days.

(21) Appl. No.: 17/629,873

(22) PCT Filed: Aug. 2, 2019

(86) PCT No.: PCT/IB2019/056605
§ 371 (c)(1),
(2) Date: Jan. 25, 2022

(87) PCT Pub. No.: WO2021/024014
PCT Pub. Date: Feb. 11, 2021

(65) Prior Publication Data

US 2022/0251458 A1 Aug. 11, 2022

(51) Int. Cl.
*C10G 65/08* (2006.01)
*C10G 45/52* (2006.01)
(Continued)

(52) U.S. Cl.
CPC ..... *C10G 65/08* (2013.01); *C10G 45/52* (2013.01); *C10G 45/54* (2013.01); *C10G 45/62* (2013.01); *C10G 45/64* (2013.01); *C10G 65/043* (2013.01)

(58) Field of Classification Search
CPC ..... C10G 45/52; C10G 45/54; C10G 45/62; C10G 45/64; C10G 65/043; C10G 65/08
See application file for complete search history.

(56) References Cited

U.S. PATENT DOCUMENTS 3,759,819 A 9/1973 Attane et al.
5,003,118 A 3/1991 Low et al.
(Continued)

FOREIGN PATENT DOCUMENTS

EP 0552070 A1 7/1993
EP 1992673 A1 11/2008
(Continued)

OTHER PUBLICATIONS

International Search Report and Written Opinion of the International Searching Authority for corresponding International Patent Application No. PCT/IB2019/056605, dated Apr. 7, 2020.

*Primary Examiner* — Renee Robinson
(74) *Attorney, Agent, or Firm* — Renner, Otto, Boisselle & Sklar, LLP

(57) ABSTRACT

A process for reducing the benzene content of a light reformate refinery stream comprises the following steps: a) reducing the benzene content by exposing the light reformate to hydrogenation conditions in a benzene-saturation reactor bed, b) increasing the octane number of the hydrogenated light reformate produced in step a) by exposing it to isomerization conditions, c) further reducing the benzene content by exposing the light reformate refinery stream to further hydrogenation conditions, wherein the isomerization of step b) occurs after step a), the hydrogenation of step c) does not precede the isomerization step b), and steps a), b) and c) are all carried out within the same reactor.

9 Claims, 2 Drawing Sheets

(51) Int. Cl.

| | |
|---|---|
| ***C10G 45/54*** | (2006.01) |
| ***C10G 45/62*** | (2006.01) |
| ***C10G 45/64*** | (2006.01) |
| ***C10G 65/04*** | (2006.01) |

(56) References Cited

U.S. PATENT DOCUMENTS

| | | | | |
|---|---|---|---|---|
| 5,210,348 | A | 5/1993 | Hsieh et al. | |
| 5,453,552 | A | 9/1995 | Rice et al. | |
| 5,578,196 | A * | 11/1996 | Travers | C10G 69/08<br>585/734 |
| 5,830,345 | A * | 11/1998 | Lee | C10G 45/54<br>208/143 |
| 2008/0286173 | A1 | 11/2008 | Shecterle | |
| 2008/0287723 | A1 | 11/2008 | Shecterle | |
| 2008/0287724 | A1 | 11/2008 | Shecterle | |
| 2012/0184790 | A1 | 7/2012 | Giyazov et al. | |

FOREIGN PATENT DOCUMENTS

| | | | |
|---|---|---|---|
| EP | 1995297 | A1 | 11/2008 |
| GB | 2319781 | A | 6/1998 |
| WO | 2006088528 | A2 | 8/2006 |

* cited by examiner

SINGLE REACTOR PROCESS FOR BENZENE-SATURATION/ISOMERTZATION OF LIGHT REFORMATES

This application is a national phase of International Patent Application No. PCT/IB2019/056605, filed Aug. 2, 2019, and published in the English language, the entire disclosure of which is hereby incorporated by reference.

FIELD OF THE INVENTION

The present invention relates to a process and a reactor for carrying out the process for reducing the benzene content of a reformate refinery stream.

BACKGROUND ART

The minimization of the benzene content in petroleum-based fuels is a long standing goal in petroleum refinery development. Since benzene is a known carcinogen, there are obvious health risks associated with the inhalation of benzene present in gasoline vapors, for example when refueling a vehicle.

By far the largest contribution to the benzene content of gasoline is provided by the reformate fraction. This reformate is the product of a catalytic reforming process, whereby low-octane naphtha obtained from crude oil distillation are converted into high-octane liquids (i.e. reformates). The reforming process involves the conversion of low-octane linear hydrocarbons (n-paraffins) into branched alkanes (iso-paraffins) and cycloalkanes (naphthenes), which are partially dehydrogenated to produce high-octane aromatic hydrocarbons, including benzene.

It has long been the practice in the field to reduce this undesired benzene content by hydrogenating (or saturating) the benzene back to e.g. cyclohexane. Since benzene has a relatively high octane number, this benzene-saturation process is accompanied by a loss of octane number. Typically, the benzene-reduced reformate is then subjected to isomerization conditions in a further reactor to compensate for this drop in octane number.

Variations on this multiple reactor process are well known in the art:

U.S. Pat. No. 5,003,118 discloses a process for converting a feedstock comprising C4-C7 paraffins and C5-C7 cyclic hydrocarbons including benzene. This invention uses a hydrogenation zone upstream of the at least two isomerization reactors to saturate benzene and simultaneously heat the feed to the isomerization zone.

U.S. Pat. No. 5,453,552 discloses an invention based on the discovery of an advantageous integration of benzene-saturation for a light paraffin containing feedstock in a light paraffin isomerization and adsorption system. This setup involves separate benzene-saturation and isomerization reactors.

U.S. Patent publication No. 2008/0286.173 A1, U.S. Patent publication No. 2008/0287723A1 U.S. Patent publication No. 2008/0287724 A1, European Patent Publication No. EP 1 995 297 A1 and European Patent Publication No. EP 1 992 673 A1 disclose a process for converting a feedstock comprising C4-C7 paraffins and C5-C7 cyclic hydrocarbons including benzene. This invention uses a hydrogenation zone upstream of the isomerization reactors to saturate benzene and simultaneously heat the feed to the isomerization zone. This setup involves a single benzene-saturation reactor and two separate isomerization reactors.

European Patent Publication No. EP 0 552 070 A1 discloses a process for reducing the content of benzene in petrol fractions in which a hydrogenation is performed of the feedstock characterized by: a weight composition included within the following ranges: —between 40 and 80% of paraffins, —between 0.5 and 7% of naphthenes, —between 6 and 45% of aromatics and a maximum distillation temperature of between 70 and 90 DEG C, followed by an isomerization of the effluent originating from the hydrogenation, the process being characterized in that a C5-C6 cut has been mixed with the said feedstock and/or the said effluent. This setup involves separate hydrogenation and isomerization units.

In U.S. Pat. No. 3,759,819 A, light gasoline fractions rich in n-hexane and optionally n-pentane, and which also contain small amounts of benzene, are first subjected to hydrogenation in contact with certain zeolite-based platinum-group metal catalyst to effect saturation of the benzene content, and total effluent from the hydrogenation zone is them subjected to isomerization in contact with a platinum group metal supported on an alumina-containing base to effect isomerization of normal paraffins to iso-paraffins. The isomerization catalyst is maintained in an active state by maintained a small proportion of hydrogen chloride in the recycle gas. Again the benzene-saturation and the isomerization steps are carried out in separate reactors.

U.S. Pat. No. 5,210,348 A is relates to a process for producing a debenzenated and isomerized product useful as a gasoline blending stock from a benzene-containing refinery stream. The process comprises reacting the benzene-comprising refinery stream in an alkylation zone with a C2-C4 olefin-containing stream in the present of an alkylation catalyst under alkylation conditions selected to alkylate at least about 30% of the benzene initially present in the refinery stream to form an alkylated stream containing both alkylated and non-alkylated benzene. The alkylated refinery stream is separated into a substantially benzene-free heavier fraction and a benzene-containing lighter fraction. The benzene-containing lighter fraction is reacted with hydrogen in a hydrogenation zone in the presence of a hydrogenation catalyst under hydrogenation conditions selected to hydrogenate substantially all of the benzene to form a debenzenated product and is reacted in an isomerization zone with an isomerization catalyst under isomerization conditions to produce the debenzenated and isomerized product, the sum of the quantities of the debenzenated and isomerized product and the substantially benzene-free heavier fraction being at least equal to those of the refinery stream.

The benzene-saturation zone and the isomerization zone of U.S. Pat. No. 5,210,348 A may either be present in the same reactor, or in separate reactors. It is however appreciated in the art that the isomerization conditions in such a dual-purpose reactor can result in the reconversion of certain hydrocarbons to benzene, meaning that no matter how efficient the initial benzene-saturation step, the capability of the process to reduce the benzene content is limited.

It is clear therefore, that there is a need for a simplified single-reactor process, utilizing the heat generated by the exothermic hydrogenation reaction for the subsequent isomerization reaction in a more efficient manner, in which the benzene content of the stream exiting the reactor is as low as possible. Such a process would not only transfer this heat more efficiently that multiple reactors using heat exchange processes, but would be beneficial for reasons of operational simplicity.

It is therefore the object of the invention to provide a process for a single-reactor benzene-saturation/isomerization/benzene-saturation protocol that maintains high benzene-saturation efficiency as well as high-octane output, as well as to provide a reactor to carry out said process.

SUMMARY OF THE INVENTION

The finding of the present invention is that a single benzene-saturation/isomerization/benzene-saturation reactor, comprising first an upper reaction zone being a benzene-saturation reactor bed and second a low reactor zone capable of effecting both isomerization and benzene-saturation can be used for the direct processing of light reformate streams, whilst attaining extremely high efficiency of benzene-saturation in addition to high-octane output.

The present invention provides a process for reducing the benzene content of a light reformate refinery stream, which comprises the following steps:

a) reducing the benzene content by exposing the light reformate to hydrogenation conditions in a benzene-saturation reactor bed, b) increasing the octane number of the hydrogenated light reformate produced in step a) by exposing it to isomerization conditions, c) further reducing the benzene content by exposing the light reformate refinery stream to further hydrogenation conditions, wherein the isomerization of step b) occurs after step a), the hydrogenation of step c) does not precede the isomerization step b), and steps a), b) and c) are all carried out within the same reactor.

In a preferred embodiment the present invention relates to a process as described above, in which step b) occurs in an isomerization reactor bed and step c) occurs in a second benzene-saturation reactor bed after the isomerization reactor bed b).

In another preferred embodiment the present invention details a process as described above, in which step c) occurs simultaneously with step b) in a dual purpose isomerization/benzene-saturation reactor bed in the presence of a single catalyst capable of catalyzing both reactions.

In a further aspect the present invention is concerned with a benzene-saturation reactor comprising:

a) an upper reactor zone, being a benzene-saturation reactor bed, which in turn comprises a hydrogenation catalyst b) a lower reactor zone, capable of effecting both isomerization and benzene-saturation, wherein the lower reactor zone b) comprises at least one reactor bed, which in turn comprises at least one catalyst at least capable of catalyzing an isomerization reaction, and the upper reactor zone is situated above the lower reactor zone The process and reactors of the invention are suitable for the reduction of benzene content of a light reformate refinery stream without suffering an accompanying decrease in octane number. In particular, the single reactor setup enables the heat generated in the exothermic benzene-saturation step to be utilized for further steps, for example an isomerization reaction that converts linear alkanes to branched alkanes. This energy recycling means that less external heating and/or cooling need be applied than in similar set-ups in the prior art, in which multiple reactors are used. The single reactor set-up is therefore more energy efficient. Furthermore the step of further reducing the benzene content by ensuring that the lower reactor zone is also capable of achieving benzene-saturation allows for an extremely low benzene content to be achieved.

Definitions

Octane number is a standard measure of the capacity of a fuel substance to withstand compression before detonating. The higher the octane number, the greater said capacity, and therefore the lower the occurrence of engine knocking, a phenomenon known to reduce the efficiency of the internal combustion process, and potentially to damage the engine. The scale upon which the octane number is based defines isooctane (2,2,4-trimethylpentane) as 100, and n-heptane as 0, with the octane number equating the fuel substance to a hypothetical mixture of isooctane and n-heptane. Since there are compounds with a greater capacity to withstand compression than isooctane, and those with a lower capacity than n-heptane, octane numbers of greater than 100 and less than 0 are possible.

There exist a number of different methods for measuring the octane number of fuels, which can lead to significantly differing values for the same fuel composition. In this document the term octane number is taken to mean the Research Octane Number (RON), which is measured according to ASTM D2699.

Reformate is the product of a hydrocarbon reforming process. Such processes are used to convert petroleum refinery naphtha distilled from crude oil, typically having low octane ratings, in high-octane liquid products (i.e. reformates). These reformates are typically characterized by high octane numbers and high benzene content (relative to other petroleum refinery fractions).

The reformate refinery stream is the stream within a petrochemical refinery that transports the reformate. As described above, the reformate refinery stream has a characteristic benzene content and octane number. Typical values are a benzene content of approx. 3.5 vol % and octane number (RON) of 96.

The light reformate refinery stream is the stream within a petrochemical refinery that transports the light reformate fraction, following a naphtha splitting process. A typical light reformate composition could compose 28.7% n-paraffins (linear alkanes), 52.6% iso paraffins (branched alkanes), 0.6% olefins, 17.0% aromatics, 1.1% naphthenes (cycloalkanes). The aromatic content of the light reformate stream is almost exclusively made up of benzene, therefore the benzene content is likewise around 17%. Typical octane numbers often fall between 80 and 83.

Benzene-reduction refers to a process that reduces the benzene content of a refinery stream. Benzene-saturation is one example of a benzene-reduction process. Others may include reacting the benzene to form other aromatic compounds, e.g. alkylation to form alkyl benzenes, or removal of the benzene through distillation or sequestration.

Isomerization is a process by which low octane linear alkanes (n-paraffins) are isomerized into high octane branched alkanes (iso-paraffins). Any reference to isomerization within this document refers exclusively to this specific isomerization reaction.

Unless specified otherwise, all reformate components and reactor bed dimensions are given as percent by volume, or vol %. Vol % is to be inferred when % is used in these cases.

Figure 2:
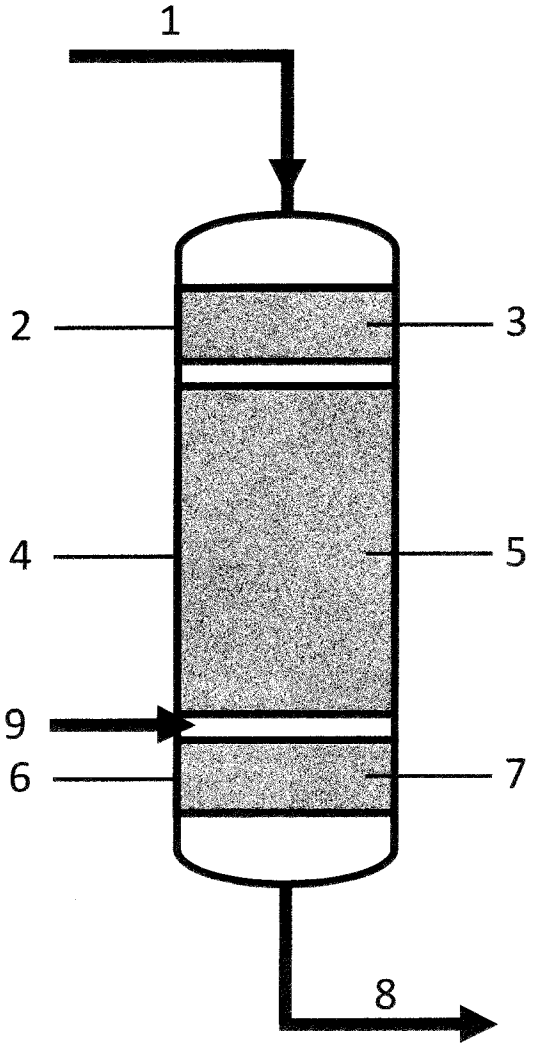
FIG. 2 is a is a schematic illustration of a reactor with three reactor beds configured in accordance with a second embodiment of the invention.

The following reference numerals are used in the detailed description with reference to the foregoing Figures:

1 light reformate stream
2 first benzene-saturation reactor bed
3 first hydrogenation catalyst
4 isomerization reactor bed
5 isomerization catalyst
6 second benzene-saturation bed
7 second hydrogenation catalyst
8 benzene-reduced light reformate stream
9 hydrogen quench
10 dual purpose isomerization/benzene-saturation reactor bed
11 dual purpose isomerization/benzene-saturation catalyst

DETAILED DESCRIPTION OF THE INVENTION

Process

The present invention relates to process (P) for reducing the benzene content of a light reformate refinery stream, which comprises the following steps:

a) reducing the benzene content by exposing the light reformate to hydrogenation conditions in a benzene-saturation reactor bed,
b) increasing the octane number of the hydrogenated light reformate produced in step a) by exposing it to isomerization conditions,
c) further reducing the benzene content by exposing the light reformate refinery stream to further hydrogenation conditions, wherein the isomerization of step b) occurs after step a), the hydrogenation of step c) does not precede the isomerization step b), and steps a), b) and c) are all carried out within the same reactor Within the same reactor is taken to mean within the same reaction vessel. Said reactor may comprise multiple reactor beds, however only a single reactor (vessel) is present.

As known to the skilled practitioner, a typical first step of reformate processing involves a splitter, in which heavier reformate, having a low benzene content, is separated from lighter reformate, which typically has a much higher benzene content. This splitter generally takes the form of a distillation column, in which the fractions are separated due to the difference in boiling points of the different components. Following this separation, the light reformate is conveyed towards a benzene-saturation unit. Between the splitter and the benzene-saturation unit, optional process steps can be undertaken, for example the removal of sulfur-containing compounds which could potentially poison any transition metal catalysts used in the benzene-saturation process. The light reformate then undergoes the benzene-reduction process (P) of the invention. The processing steps described above that occur prior to the benzene-reduction process (P) are not the object of the present invention, but are merely steps that the skilled practitioner could selected from standard process steps, well-known in the art. The selection of these prior steps is well established, and would be trivial to one skilled in the art.

The benzene-reduction process of the invention (P) firstly involves a hydrogenation reaction, in which benzene is hydrogenated to e.g. cyclohexane. This hydrogenation reaction requires both a hydrogenation catalyst, present in the benzene-saturation reactor bed and hydrogen gas. This hydrogen gas can be supplied either directly to the reactor, or can be mixed with the light reformate refinery stream to be fed into the reactor before the stream enters the reactor. The hydrogen feed is introduced as part of the benzene-reduction process of the invention (P), and therefore does not constitute a processing step preceding the benzene-reduction process (P), as described above. The skilled practitioner would understand that the provision of a hydrogen feed is a prerequisite for a hydrogenation reaction (i.e. hydrogenation conditions), and that the process of the present invention (P) does not concern itself with how the provision of this hydrogen feed is to be achieved.

The inlet temperature of the reactor is preferably at least 150° C., more preferably at least 155° C., most preferably at least 160° C. It is also preferred that the inlet temperature is no greater than 180° C., more preferably no greater than 175° C., most preferably not greater than 170° C. Alternatively, it is preferred that the inlet temperature of the reactor is within the range of 150 to 180° C., more preferably within the range 155 to 175° C., most preferably within the range 160 to 170° C.

The inlet pressure of the reactor is preferably at least 25 $kg/cm^2$ g, more preferably at least 28 $kg/cm^2$ g, most preferably at least 30 $kg/cm^2$ g. It is also preferred that the inlet pressure is no greater than 40 $kg/cm^2$ g, more preferably no greater than 35 $kg/cm^2$ g, most preferably not greater than 33 $kg/cm^2$ g. Alternatively, it is preferred that the inlet pressure of the reactor is within the range of 25 to 40 $kg/cm^2$ g, more preferably within the range 28 to 35 $kg/cm^2$ g, most preferably within the range 30 to 33 $kg/cm^2$ g.

The hydrogenation catalyst of the benzene-saturation reactor bed of step a) may comprise substantially any catalyst capable of catalyzing the hydrogenation of benzene to e.g. cyclohexane. Such a catalyst will comprise a transition metal dispersed on an inorganic support. Examples include platinum on alumina and nickel on alumina. Especially preferred is platinum on alumina.

The outlet temperature of the benzene-saturation reactor bed of step a) is preferably at least 180° C., more preferably at least 190° C., most preferably at least 195° C. It is also preferred that the outlet temperature is no greater than 210° C., more preferably no greater than 207° C., most preferably not greater than 205° C. Alternatively, it is preferred that the outlet temperature of the benzene-saturation reactor bed of step a) is within the range of 180 to 210° C., more preferably within the range 190 to 207° C., most preferably within the range 195 to 205° C.

Since the hydrogenation of benzene is an exothermic process, the liquid that exits the benzene-saturation reactor bed of step a) is heated relative to the liquid that is fed into said reactor bed, as can be seen from the inlet and outlet temperatures specified above. This heated liquid is then exposed to the isomerization conditions of step b) under which the hydrocarbon components of the heated liquid undergo an isomerization reaction. This isomerization reaction has the effect of converting linear alkyl chains into branched alkyl chains. Since the octane number of hydrocarbons increases with the degree of branching, the octane number of light reformate stream is enhanced. This increase in octane number compensates for any loss of octane number in the benzene-saturation process.

For the isomerization reaction to proceed, high temperatures are required. In the prior art this is usually achieved through the use of external heating. In the benzene-reduction process (P) of the invention, the heat generated from the exothermic benzene-hydrogenation reaction contributes to heating the light reformate refinery stream passing through the reactor, and therefore the need for external heating is reduced, more preferably eliminated.

As is known in the art, the isomerization conditions of step b) require very high temperatures, and as such, it is observed that some of the benzene-reduced light reformate is converted into benzene. Consequently, whilst the efficiency of the first benzene-saturation step may be up to 100%, the effect of the combination of steps a) and b) is that some benzene is still present upon exiting the reactor. Since it is desirable to have a benzene content as low as possible, it is therefore required to expose the light reformate refinery stream to further hydrogenation conditions.

The octane number of the benzene-reduced light reformate produced according to the invention is preferably not lower than that of the light reformate refinery stream fed into the reactor of the process (P).

The n-paraffin (linear alkane) content of the light reformate refinery stream fed into the reactor is preferably in the range of 20 to 35 vol %, more preferably 23 to 32 vol %, most preferably 25 to 30 vol %.

The iso-paraffin (branched alkane) content of the light reformate refinery stream fed into the reactor is preferably in the range of 40 to 60 vol %, more preferably 43 to 57 vol %, most preferably 45 to 55 vol %.

The olefin content of the light reformate refinery stream fed into the reactor is preferably in the range of 0.05 to 2.0 vol %, more preferably 0.1 to 1.5 vol %, most preferably 0.1 to 1.0 vol %.

The aromatic content of the light reformate refinery stream fed into the reactor is preferably in the range of 10 to 25 vol %, more preferably 13 to 27 vol %, most preferably 15 to 20 vol %.

The naphthene (cycloalkane) content of the light reformate refinery stream fed into the reactor is preferably in the range of 0.1 to 3.0 vol %, more preferably 0.3 to 2.5 vol %, most preferably 0.5 to 2.0 vol %.

The benzene content of the light reformate refinery stream fed into the reactor is preferably in the range of 10 to 25 vol %, more preferably 13 to 27 vol %, most preferably 15 to 20 vol %.

The n-paraffin (linear alkane) content of the benzene-reduced light reformate produced according to the process (P) of the invention is preferably in the range of 3.0 to 15 vol %, more preferably 4.0 to 12 vol %, most preferably 5.0 to 10 vol %.

The iso-paraffin (branched alkane) content of the benzene-reduced light reformate produced according to the process (P) of the invention is preferably in the range of 60 to 85 vol %, more preferably 63 to 87 vol %, most preferably 65 to 80 vol %.

The olefin content of the benzene-reduced light reformate produced according to the process (P) of the invention is preferably less than 0.2 vol %, preferably less than 0.1 vol %. Most preferably no olefin can be detected in the benzene-reduced reformate produced according to the invention.

The aromatic content of the benzene-reduced light reformate produced according to the process (P) of the invention is preferably less than 0.5 vol %, more preferably less than 0.3 vol %, most preferably less than 0.2 vol %.

The naphthene (cycloalkane) content of the benzene-reduced light reformate produced according to the process (P) of the invention is preferably in the range of 10 to 25 vol %, more preferably 13 to 22 vol %, most preferably 15 to 20 vol %.

The benzene content of the benzene-reduced light reformate produced according to the process (P) of the invention is preferably less than 0.5 vol %, more preferably less than 0.3 vol %, most preferably less than 0.2 vol %.

The liquid hourly space velocity (LHSV) of the light reformate refinery stream through the reactor of the process of the present invention is preferably in the range of 1.5 to 4.5 $h^{31\ 1}$, more preferably 2.0 to 4.0 $h^{-1}$, most preferably 2.4 to 3.8 $h^{-1}$.

The liquid hourly space velocity (LHSV) of the light reformate refinery stream through the first benzene-saturation reactor bed of step a) is preferably in the range of 30 to 50 $h^{-1}$, more preferably 34 to 46 $h^{-1}$, most preferably 38 to 42 $g^{-1}$.

The benzene-reduced light reformate produced as a result of the benzene-reduction process (P) of the invention may optionally be further processed subsequent to the said process (P), before being mixed with other refinery streams.

The benzene content of the benzene-reduced light reformate produced according to the process of the invention is preferably less than 0.5 vol %, more preferably less than 0.3 vol %, most preferably less than 0.2 vol %.

Figure 1:
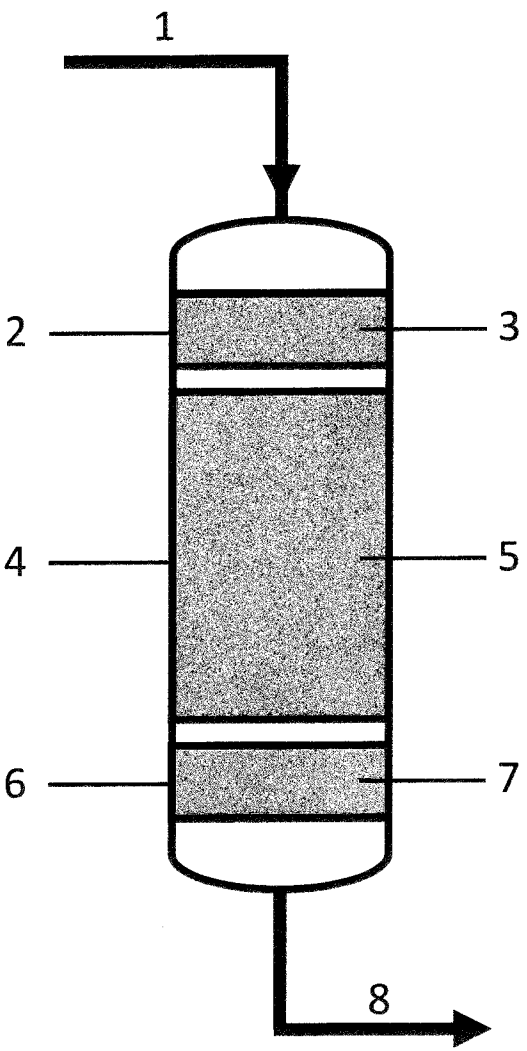
FIG. 1 is a schematic illustration of a reactor with three reactor beds configured in accordance with a first embodiment of the invention.
Figure 3:
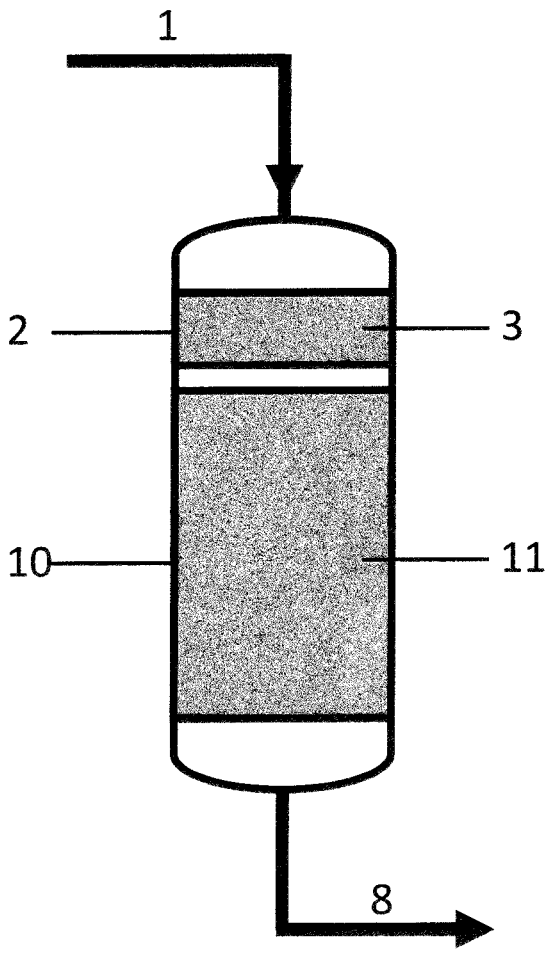
FIG. 3 is a is a schematic illustration of a reactor with three reactor beds configured in accordance with a third embodiment of the invention.

The combination of steps described above can lead to one of two reactor setups, as shown in FIGS. 1, 2 and 3.

One preferred embodiment involves a reactor setup with 3 reactor beds, a first benzene-saturation reactor bed, an isomerization reactor bed and a second benzene-saturation reactor bed, in that order, as illustrated by FIG. 1. This results in a process in which step b) occurs in an isomerization reactor bed and step c) occurs in a second benzene-saturation reactor bed after the isomerization reactor bed of step b).

The isomerization reactor bed of step b) comprises an isomerization catalyst. Said isomerization catalyst may comprise a transition metal dispersed on an inorganic support. Examples include platinum on a sulfated metal oxide, platinum and/or nickel on a zeolite alumina (ZSM-5), platinum and/or nickel on zirconia-alumina or platinum on chlorinated alumina. Especially preferred is platinum on a sulfated metal oxide.

The second benzene-saturation reactor bed of step b) comprises a second hydrogenation catalyst. Said second hydrogenation catalyst may comprise substantially any catalyst capable of catalyzing the hydrogenation of benzene to e.g. cyclohexane. Such a catalyst will comprise a transition metal dispersed on an inorganic support. Examples include platinum on alumina and nickel on alumina. Especially preferred is platinum on alumina.

The second hydrogenation catalyst of step c) may be the same as or different from the hydrogenation catalyst of step a), preferably the same.

The outlet temperature of the isomerization reactor bed of step b) is preferably at least 200° C., more preferably at least 210° C., most preferably at least 215° C. It is also preferred that the outlet temperature is no greater than 230° C., more preferably no greater than 227° C., most preferably not greater than 225° C. Alternatively, it is preferred that the outlet temperature of the isomerization reactor bed of step b) is within the range of 200 to 230° C., more preferably within the range 210 to 227° C., most preferably within the range 215 to 225° C.

The outlet temperature of the benzene-saturation reactor bed of step c) is preferably at least 240° C., more preferably at least 250° C., most preferably at least 255° C. It is also preferred that the outlet temperature is no greater than 280° C., more preferably no greater than 270° C., most preferably not greater than 265° C. Alternatively, it is preferred that the outlet temperature of the benzene-saturation reactor bed of step c) is within the range of 240 to 280° C., more preferably within the range 250 to 270° C., most preferably within the range 255 to 265° C.

In this embodiment, the catalyst volume of the benzene-saturation reactor bed of step a) is between 2.5 and 10.0 vol %, more preferably between 4.0 and 8.5 vol %, most preferably between 5.5 and 7.0 vol % of the total reactor volume.

The catalyst volume of the isomerization reactor bed of step b) is between 80 and 95 vol %, more preferably between 83 and 92 vol %, most preferably between 86 and 89 vol % of the total reactor volume.

The catalyst volume of the benzene-saturation reactor bed of step c) is between 2.5 and 10.0 vol %, more preferably between 4.0 and 8.5 vol %, most preferably between 5.5 and 7.0 vol % of the total reactor volume.

The liquid hourly space velocity (LHSV) of the light reformate refinery stream through the reactor of the process of the present invention is preferably in the range of 1.5 to 3.5 $h^{-1}$, more preferably 2.0 to 3.0 $h^{-1}$, most preferably 2.4 to 2.8 $h^{-1}$.

The liquid hourly space velocity (LHSV) of the light reformate refinery stream through the isomerization reactor bed of step b) is preferably in the range of 2.0 to 4.0 $h^{-1}$, more preferably 2.4 to 3.6 $h^{-1}$, most preferably 2.8 to 3.2 $h^{-1}$.

The liquid hourly space velocity (LHSV) of the light reformate refinery stream through the second benzene-saturation reactor bed of step c) is preferably in the range of 30 to 50 $h^{-1}$, more preferably 34 to 46 $h^{-1}$, most preferably 38 to 42 $h^{-1}$.

As illustrated in FIG. 2, there may optionally be a hydrogen quench step between steps b) and c). As previously discussed, the benzene-saturation reaction is exothermic, therefore the liquid exiting the second benzene-saturation reactor bed, and thus the reactor, is likely to be extremely hot. Adjustments to the reactor can be made in order to accommodate this superheated liquid, however it is much simpler, and therefore cheaper in terms of reactor design, to introduce a hydrogen quench step to reduce the temperature before the second benzene-saturation bed, ensuring that temperature of the liquid exiting said bed, and the reactor, is not too high.

Another equally preferred embodiment involves a reactor setup with 2 reactor beds, a first benzene-saturation reactor bed, and an isomerization/benzene-saturation reactor bed, as illustrated by FIG. 3. The isomerization/benzene-saturation reactor bed contains a single catalyst, capable of catalyzing both reactions. In other words step c) occurs simultaneously with step b) in a dual purpose isomerization/benzene-saturation reactor bed.

The catalyst of the dual purpose isomerization/benzene-saturation reactor bed of step b) is preferably either platinum and tin on alumina or platinum on zeolite, more preferably platinum and tin on alumina.

The outlet temperature of the isomerization/benzene-saturation bed of steps b) and c) is preferably at least 190° C., more preferably at least 200° C., most preferably at least 210° C. It is also preferred that the outlet temperature is no greater than 240° C., more preferably no greater than 230° C., most preferably not greater than 220° C. Alternatively, it is preferred that the outlet temperature of the isomerization/benzene-saturation bed of steps b) and c) is within the range of 190 to 240° C., more preferably within the range 200 to 230° C., most preferably within the range 210 to 220° C.

In this embodiment, the catalyst volume of the benzene-saturation reactor bed of step a) is between 5.0 and 15.0 vol %, more preferably between 6.0 and 13.0 vol %, most preferably between 7.0 and 11.0 vol % of the total reactor volume.

The catalyst volume of the dual purpose isomerization/benzene-saturation reactor bed is between 85 and 95 vol %, more preferably between 87 and 94 vol %, most preferably between 89 and 93 vol % of the total reactor volume.

The liquid hourly space velocity (LHSV) of the light reformate refinery stream through the reactor of the process of the present invention is preferably in the range of 2.5 to 4.5 $h^{-1}$, more preferably 3.0 to 4.0 $h^{-1}$, most preferably 3.4 to 3.8 $h^{-1}$.

The liquid hourly space velocity (LHSV) of the light reformate refinery stream through the dual purpose isomerization/benzene-saturation reactor bed is preferably in the range of 3.0 to 5.0 $h^{-1}$, more preferably 3.4 to 4.6 $h^{-1}$, most preferably 3.8 to 4.2 $h^{-1}$.

The process of the invention is preferably carried out using the reactor as described below.

Reactor

The present invention further relates to a reactor that may be used for the process of the invention as described in the preferred embodiments illustrated in FIGS. 1, 2 and 3.

The invention therefore provides a benzene-saturation reactor comprising:

a) an upper reactor zone, being a benzene-saturation reactor bed, which in turn comprises a hydrogenation catalyst b) a lower reactor zone, capable of effecting both isomerization and benzene-saturation, wherein the lower reactor zone b) comprises at least one reactor bed, which in turn comprises at least one catalyst at least capable of catalyzing an isomerization reaction, and the upper reactor zone is situated above the lower reactor zone.

The inlet to the reactor is provided at the top of said reactor, i.e. above all of the reactor zones as described. The outlet from the reactor is provided at the bottom of said reactor, i.e. below all of the reactor zones as described.

The hydrogenation catalyst of the upper reactor zone may comprise substantially any catalyst capable of catalyzing the hydrogenation of benzene to e.g. cyclohexane. Such a catalyst will comprise a transition metal dispersed on an inorganic support. Examples include platinum on alumina and nickel on alumina. Especially preferred is platinum on alumina.

In one embodiment the lower reactor zone comprises:

b1) an isomerization reactor bed, comprising an isomerization catalyst, b2) a second benzene-saturation reactor bed, comprising a hydrogenation catalyst, wherein the isomerization reactor bed b1) is situated above the second benzene-saturation reactor bed b2)

The isomerization catalyst of the isomerization reactor bed b1) may comprise a transition metal dispersed on an inorganic support. Examples include platinum on a sulfated metal oxide, platinum and/or nickel on a zeolite alumina (ZSM-5), platinum and/or nickel on zirconia-alumina or platinum on chlorinated alumina. Especially preferred is platinum on a sulfated metal oxide.

The hydrogenation catalyst of the second benzene-saturation bed b2) may comprise substantially any catalyst capable of catalyzing the hydrogenation of benzene to e.g. cyclohexane. Such a catalyst will comprise a transition metal dispersed on an inorganic support. Examples include platinum on alumina and nickel on alumina. Especially preferred is platinum on alumina.

The hydrogenation catalyst of the second benzene-saturation reactor bed b2) may be the same as or different from the hydrogenation catalyst of the upper reactor zone a), preferably the same.

In this embodiment, the catalyst volume of the first benzene-saturation reactor bed a) is between 2.5 and 10.0 vol %, more preferably between 4.0 and 8.5 vol %, most preferably between 5.5 and 7.0 vol % of the total reactor volume.

The catalyst volume of the isomerization reactor bed b1) is between 80 and 95 vol %, more preferably between 83 and 92 vol %, most preferably between 86 and 89 vol % of the total reactor volume.

The catalyst volume of the second benzene-saturation reactor bed b2) is between 2.5 and 10 vol %, more preferably between 4.0 and 8.5 vol %, most preferably between 5.5 and 7.0 vol % of the total reactor volume.

In this embodiment, there may be an inlet suitable for introducing a hydrogen quench to the reactor, between the isomerization reactor bed b1) and the second benzene-saturation reactor bed b2).

In an equally preferred embodiment the lower reactor zone is a mixed benzene-saturation/isomerization reactor bed, comprising a catalyst capable of catalyzing both benzene-saturation and isomerization.

In this embodiment, the catalyst volume of the first benzene-saturation reactor bed a) is between 5.0 and 15.0 vol %, more preferably between 6.0 and 13.0 vol %, most preferably between 7.0 and 11.0 vol % of the total reactor volume.

The catalyst volume of the dual purpose isomerization/benzene-saturation reactor bed is between 85 and 95 vol %, more preferably between 87 and 94 vol %, most preferably between 89 and 93 vol % of the total reactor volume.

The catalyst of the dual purpose isomerization/benzene-saturation reactor bed of step b) is preferably either platinum and tin on alumina or platinum on zeolite, more preferably platinum and tin on alumina.

The invention claimed is:

1. A process for reducing the benzene content of a light reformate refinery stream containing benzene, which comprises the following steps:

a) reducing the benzene content by exposing the light reformate to hydrogenation conditions in a first benzene-saturation reactor bed, b) increasing the octane number of the hydrogenated light reformate produced in step a) by exposing it to isomerization conditions, and c) further reducing the benzene content by exposing the light reformate refinery stream to further hydrogenation conditions, wherein the isomerization of step b) occurs after step a), the hydrogenation of step c) occurs after the isomerization step b), and steps a), b) and c) are all carried out within the same reactor.

2. The process according to claim 1, in which step b) occurs in an isomerization reactor bed and step c) occurs in a second benzene-saturation reactor bed after the isomerization reactor bed of step b).

3. The process according to claim 2, in which the catalyst volumes of the reactor beds are as follows:

a) the catalyst volume of the first benzene-saturation reactor bed of step a) is between 2.5 and 10.0 vol % of the total reactor volume, b) the isomerization reactor bed of step b) is between 80 and 95 vol %, more preferably between 83 and 92 vol % of the total reactor volume, and c) the catalyst volume of the second benzene-saturation reactor bed of step c) is between 2.5 and 10 vol % of the total reactor volume.

4. The process according to claim 2, further comprising a hydrogen quench step between steps b) and c).

5. The process according to claim 1, wherein the single reactor of the process is operated under one or more of the following reactor conditions:

a) a reactor inlet temperature within the range of 150 to 180° C., b) a reactor inlet pressure within the range of 25 to 40 $kg/cm^2$ g, c) a liquid hourly space velocity (LHSV) in the range of 1.5 to 4.5 $h^{-1}$.

6. The process according to claim 1, wherein the research octane number (RON) of the benzene-reduced light reformate exiting the reactor is not lower than that of the light reformate refinery stream fed into the reactor of the process.

7. The process according to claim 1, wherein the benzene content of the benzene-reduced light reformate produced according to the process is less than 0.5 vol %.

8. A benzene-saturation reactor comprising:

a) an upper reactor zone, being a first benzene-saturation reactor bed, which in turn comprises a hydrogenation catalyst b) a lower reactor zone, capable of effecting both isomerization and benzene-saturation, comprising:

b1): an isomerization reactor bed, comprising an isomerization catalyst, b2) a second benzene-saturation reactor bed, comprising a hydrogenation catalyst, wherein the isomerization reactor bed b1) is situated above the second benzene saturation bed b2), and the upper reactor zone is situated above the lower reactor zone.

9. A benzene-saturation reactor according to claim 8, in which a hydrogen feed is situated between the isomerization reactor bed b1) and the second benzene-saturation reactor bed b2).

* * * * *